US008279126B2

(12) United States Patent
Yanagi et al.

(10) Patent No.: US 8,279,126 B2
(45) Date of Patent: Oct. 2, 2012

(54) COMMUNICATION DEVICE AND SYSTEM INCLUDING THE SAME

(75) Inventors: Masahiro Yanagi, Shinagawa (JP); Shigemi Kurashima, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 383 days.

(21) Appl. No.: 12/422,331

(22) Filed: Apr. 13, 2009

(65) Prior Publication Data

US 2010/0053000 A1 Mar. 4, 2010

(30) Foreign Application Priority Data

Aug. 27, 2008 (JP) ..... 2008-217587

(51) Int. Cl.
*H01Q 11/12* (2006.01)
*H01Q 7/00* (2006.01)
*H01Q 1/24* (2006.01)

(52) U.S. Cl. ..... 343/741; 343/866; 343/702

(58) Field of Classification Search ..... 343/741, 343/744, 866, 732, 702
See application file for complete search history.

(56) References Cited

U.S. PATENT DOCUMENTS

| | | | | |
|---|---|---|---|---|
| 2,235,163 | A * | 3/1941 | Peterson | 343/732 |
| 4,083,006 | A * | 4/1978 | Yokoshima | 455/115.1 |
| 6,243,045 | B1 * | 6/2001 | Ishibashi | 343/741 |
| 6,359,594 | B1 * | 3/2002 | Junod | 343/744 |
| 6,864,849 | B2 * | 3/2005 | Hart | 343/773 |
| 7,209,281 | B2 * | 4/2007 | Takei | 359/296 |
| 7,917,226 | B2 * | 3/2011 | Nghiem et al. | 607/60 |

FOREIGN PATENT DOCUMENTS

| | | |
|---|---|---|
| GB | 1 507 674 | 4/1978 |
| GB | 1 515 533 | 6/1978 |
| JP | 2006-19979 A | 1/2006 |
| JP | 2006-031473 | 2/2006 |
| JP | 2006-333069 | 12/2006 |

* cited by examiner

*Primary Examiner* — Hoang V Nguyen
(74) *Attorney, Agent, or Firm* — IPUSA, PLLC

(57) ABSTRACT

A communication device is disclosed that includes an antenna apparatus including: a feeding portion, a looped antenna element connected to the feeding portion, and a resistor inserted into the looped antenna element; and a communication circuit configured to process data that is transmitted and received via the antenna apparatus.

13 Claims, 11 Drawing Sheets

COMMUNICATION DEVICE AND SYSTEM INCLUDING THE SAME

BACKGROUND OF THE INVENTION

1. Field of the Invention

The present invention relates to a communication device that provides proximal communications in wide band, and a system including the same.

2. Description of the Related Art

A communication sheet that includes a plurality of proximal coupling portions and a plurality of relay communication circuits arranged on the surface of the sheet wherein each relay communication circuit forms a communication network with the proximal coupling portions and other relay communication circuits, has been proposed.

The communication sheet data communicates with other communication sheets via the proximal coupling portions when the communication sheet touches or comes closer to other communication sheets. The communication sheet like this has been proposed in order to form a wireless communication network such as wireless LAN (Local Area Network). [Patent Document 1] Japanese Patent Laid-Open Publication No. 2006-19979

Since the communication sheet described above forms a communication network with other communication sheets by using capacitive coupling and the communication circuit of the communication sheet includes an LC circuit, the communication band becomes narrower and wide band communication becomes difficult.

Moreover, it is difficult to protect data confidentiality because the communication network formed by using capacitive coupling may leak electromagnetic waves or radio waves.

SUMMARY OF THE INVENTION

It is a general object of the present invention to provide a communication device and a system including the same that provide wide band communication, higher data confidentiality, and easier proximal communications.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a communication device and a system including the same particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides a communication device including: an antenna apparatus including: a feeding portion, a looped antenna element connected to the feeding portion, and a resistor inserted into the looped antenna element; and a communication circuit configured to process data that is transmitted and received via the antenna apparatus.

Another embodiment of the present invention provides a communication device including: an antenna apparatus including: a ground plane, a slot portion formed in the ground plane, a feeding portion connected to the ground plane at opposite sides of the slot portion, and a resistor spaced from the feeding portion and including opposite ends connected to the ground plane in such a manner that the resistor is disposed over the slot portion; and a communication circuit configured to process data that is transmitted and received via the antenna apparatus.

Yet another embodiment of the present invention provides a system comprising: a first communication device including: a first antenna apparatus including: a first feeding-portion, a looped antenna element connected to the first feeding portion, and a first resistor inserted into the looped antenna element, and a first communication circuit configured to process data that is transmitted and received via the first antenna apparatus; and a second communication device including: a second antenna apparatus including: a ground plane, a slot portion formed in the ground plane, a second feeding portion connected to the ground plane at opposite sides of the slot portion, and a second resistor spaced from the feeding portion and including opposite ends connected to the ground plane in such a manner that the resistor is disposed over the slot portion, and a second communication circuit configured to process data that is transmitted and received via the second antenna apparatus.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Embodiment 1

Figure 1:
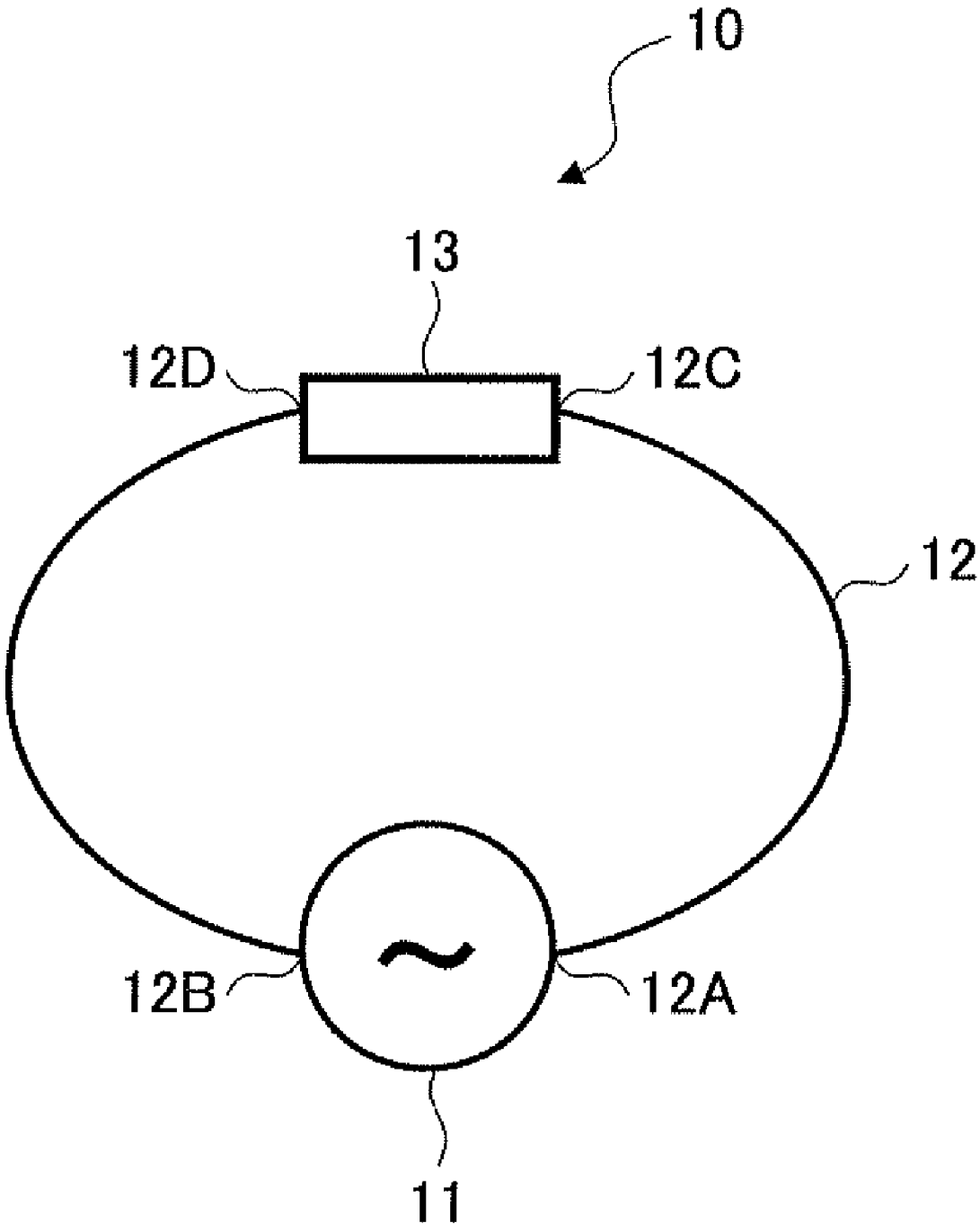
FIG. 1 is a schematic drawing of an antenna apparatus included in a communication device according to embodiment 1.

FIG. 1 is a schematic drawing of an antenna apparatus included in a communication device according to embodiment 1.

As shown in FIG. 1, an antenna apparatus 10 included in a communication device of embodiment 1 includes a feeding portion 11, an antenna element 12 formed into a loop shape and connected to the feeding portion 11, and a resistor 13 inserted into the antenna element 12. The resistor 13 becomes a portion of a loop formed by connection with the antenna element 12.

One end 12A and the other end 12B of the antenna element 12 are connected to the feeding portion 11. The resistor 13 is inserted at the midpoint between the one end 12A and the other end 12B of the antenna element 12.

The feeding portion 11 is a terminal via which electrical power is fed to the antenna element 12 from an external power supply. A terminal of a coaxial cable, for example, is connected to the feeding portion 11.

A cable core of the coaxial cable is connected to the one end 12A of the antenna element 12, and a shielded line of the coaxial cable is connected to the other end 12B of the antenna element 12, for example.

A high-frequency voltage, for example at around 3 GHz to 5 GHz, is applied to the feeding portion 11 via the coaxial cable.

The high-frequency voltage is fed to the antenna element 12 via the feeding portion 11. The antenna element 12 is made of, for example, copper. The antenna element 12 may be an antenna element made of copper and patterned into a loop shape on a surface of a printed circuit board, for example.

Further, the antenna apparatus 10 includes the resistor 13 which is disposed at the midpoint between the one end 12A and the other end 12B of the antenna element 12. More specifically, the resistor 13 is connected between connecting points 12C and 12D of the antenna element 12 in order to form the loop.

Although the antenna element 12 shown in FIG. 1 is formed into a loop shape, the antenna element 12 may be formed into a rhombic shape, i.e. a rhombic antenna. A rhombic antenna has an advantageous effect in a case that directional characteristics are necessary or desired.

The length of the antenna element 12 connected to the feeding portion 11 may be, for example, made approximately equal to a single-wavelength of the communication frequency at which the communication device operates. In the case that the communication frequency is 3 GHz, the length of the antenna element 12, i.e. the length between the one end 12A and the other end 12B and the length of the resistor 13 inserted thereinto, becomes 100 mm.

The resistor 13 is inserted into the antenna element 12 between the one end 12A and the other end 12B. The resistance of the resistor 13 may be set to, for example, 1 kΩ. Although the resistance of the resistor 13 is set to 1 kΩ, the resistance is not limited to 1 kΩ. The resistance can be varied as long as the proximal communication of which the communication distance is less than a few centimeters can be provided.

As the antenna element of embodiment 1 is designed to provide less than a few centimeters proximal communication by using the antenna element 12 with the resistor 13 inserted thereinto, almost all of the electrical power fed via the feeding portion 11 is consumed at the resistor 13.

The antenna apparatus 10 included in the communication device of embodiment 1 includes the antenna element 12 and the resistor 13. In addition, the antenna apparatus 10 included in the communication device of embodiment 1 does not include inductance (L) or capacitance (C).

The antenna apparatus 10 included in the communication device of embodiment 1 provides an ultra-wide frequency band when a high-frequency voltage is fed to the antenna element 12 via the feeding portion 11. In addition, because the as-shown antenna apparatus 10 included in the communication device of embodiment 1 does not include inductance (L) or capacitance (C), the antenna apparatus 10 does not cause resonance.

Figure 2:
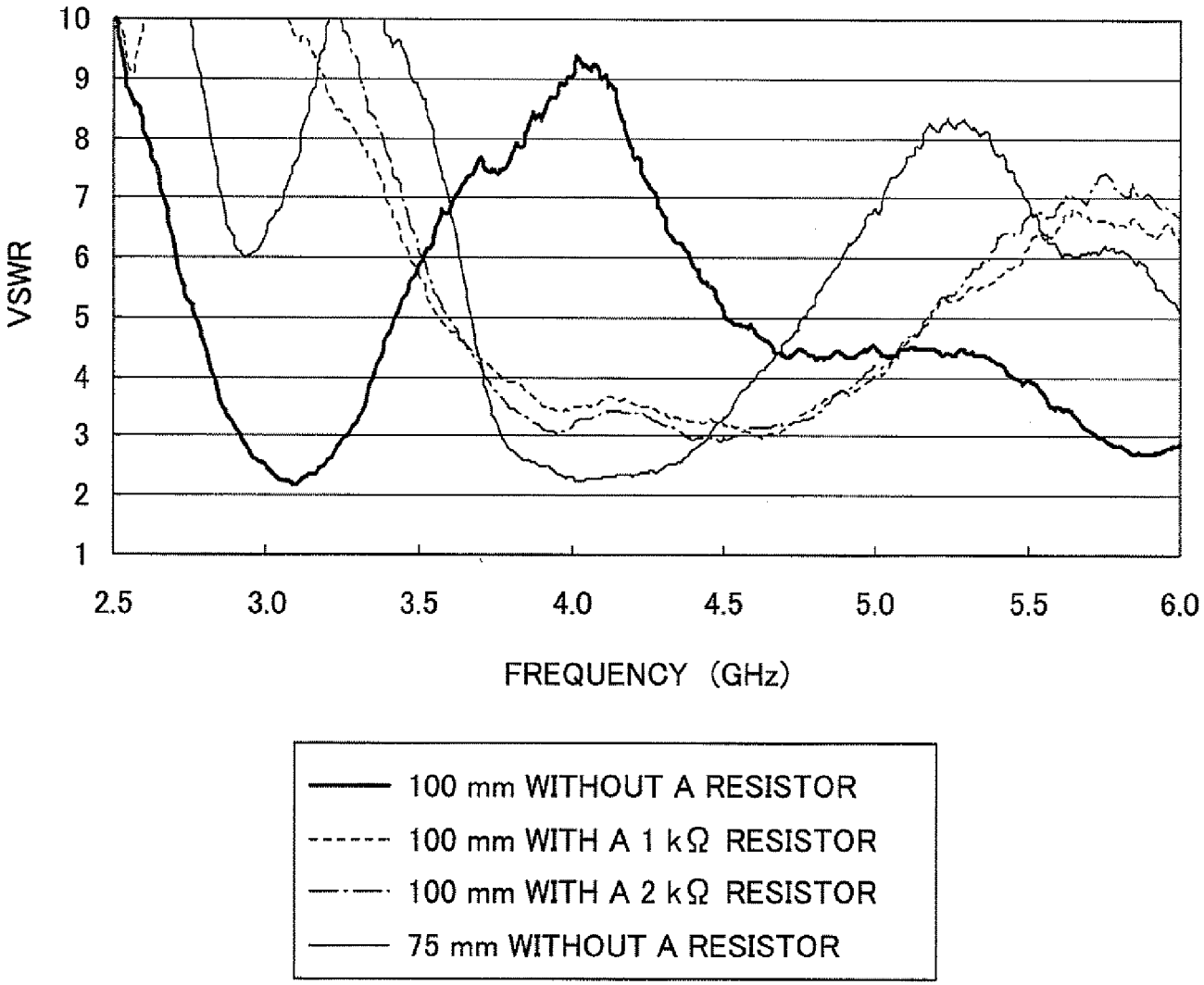
FIG. 2 is a graph showing VSWR (Voltage Standing Wave Ratio) characteristics of an antenna apparatus included in a communication device of embodiment 1.

FIG. 2 is a graph showing VSWR (Voltage Standing Wave Ratio) characteristics of an antenna apparatus included in a communication device of embodiment 1.

The VSWR characteristic represented in dashed line shown in FIG. 2 is obtained in the condition where the length of the antenna element 12 and the resistor 13 is 100 mm, and the resistance of the resistor 13 is 1 kΩ. As to the other characteristics shown in FIG. 2, the alternating long and short dash line characteristic is obtained by an antenna element and a resistor having a length of 100 mm and the resistance is 2 kΩ, the heavy solid line characteristic is obtained by an antenna element and a resistor having a length of 100 mm and the resistance is 0 kΩ(i.e. without a resistor), and the solid line characteristic is obtained with an antenna element and a resistor having a length of 75 mm and the resistance is 0 kΩ (i.e. without a resistor). These three characteristics are shown for comparison.

As shown in the dashed line VSWR characteristic, the antenna apparatus 10 provides a frequency band, with VSWR less than 4.0, ranged from 3.7 GHz to 5.0 GHz, i.e. the band width is 1.3 GHz. The same characteristic is obtained with the antenna apparatus that has a 2 kΩ resistor.

In contrast, as shown in the heavy solid line VSWR characteristic, the antenna apparatus (100 mm, 0 kΩ) provides a frequency band, with VSWR less than 4.0, ranged from 2.8 GHz to 3.4 GHz, i.e. the band width is narrowed to 0.6 GHz. This frequency band is shifted out of the frequency band ranged from 3 GHz to 5 GHz that is available to UWB communication.

Further, as shown in the solid line VSWR characteristic, the antenna apparatus (75 mm, 0 kΩ) provides a frequency band, with VSWR less than 4.0, ranged from 3.7 GHz to 4.6 GHz, i.e. the band width is narrowed to 0.9 GHz.

As will be appreciated from the above, the antenna apparatus included in the communication device of embodiment 1 provides an ultra wide frequency band that is suitable for UWB communication, and the band width is 1.4 times wider than that of the antenna apparatus (75 mm, 0 kΩ).

According to embodiment 1 of the present invention, it is possible to provide an antenna apparatus that has a frequency band suitable for UWB communication by inserting a resistor into a looped antenna element.

Moreover, since the electrical power is consumed at the resistor 13, the antenna apparatus of embodiment 1 is suitable for a low electrical power communication use. And the communication distance may be set to less than a few centimeters. This communication distance makes it possible to not be influenced by a disturbance.

Further, the antenna apparatus 10 of embodiment 1 includes the antenna element 12 and the resistor 13. In addition, the antenna apparatus 10 of embodiment 1 does not include inductance (L) or capacitance (C).

The antenna apparatus 10 provides an ultra-wide frequency band when a high-frequency voltage is fed to the antenna element 12 via the feeding portion 11. In addition, because the as-shown antenna apparatus 10 does not include inductance (L) or capacitance (C), the antenna apparatus 10 does not cause resonance.

As described above, according to embodiment 1, a traveling-wave-type antenna apparatus that is suitable for low electrical power communication and wide band communication is provided merely by inserting the resistor into the looped antenna element 12.

As shown in the VSWR characteristics, since the antenna apparatus has a wide band, large volume UWB data communication becomes available.

It is noted that the antenna element 12 and resistor 13 may be formed on the printed circuit board by patterning a metal film formed over the printed circuit board.

Although the resistor 13 of the above-described embodiment is inserted into the midpoint between the one end 12A and the other end 12B of the antenna element 12, the insertion position of resistor 13 between the ends 12A and 12B is not limited thereto. The resistor 13 may be inserted into any position between the ends 12A and 12B as long as the low electrical power UWB communication is provided.

Figure 3A:
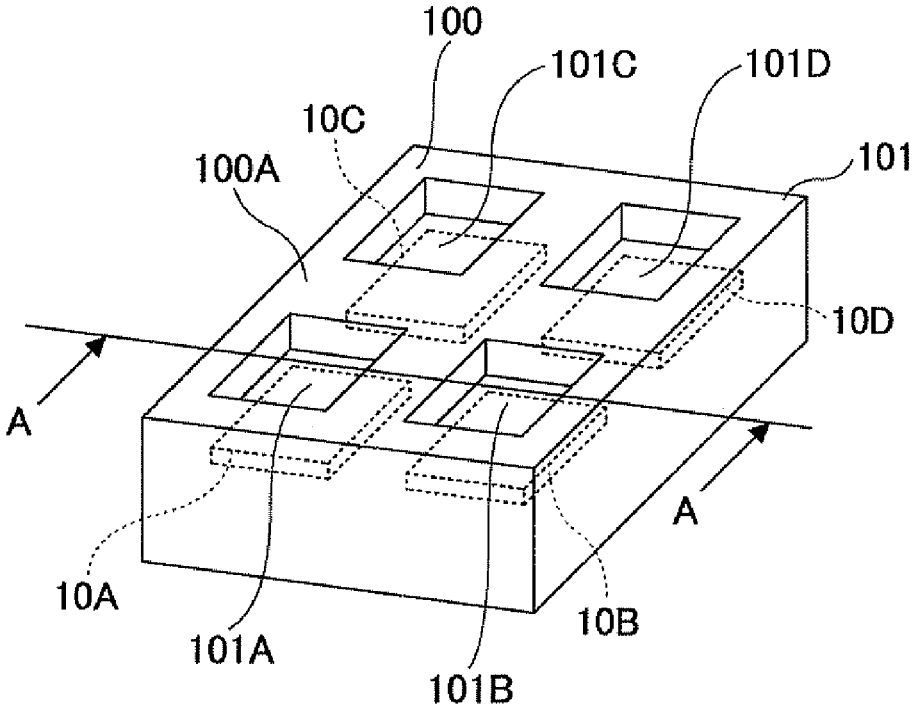
FIG. 3A is a schematic drawing of the communication device according to embodiment 1.
Figure 3B:
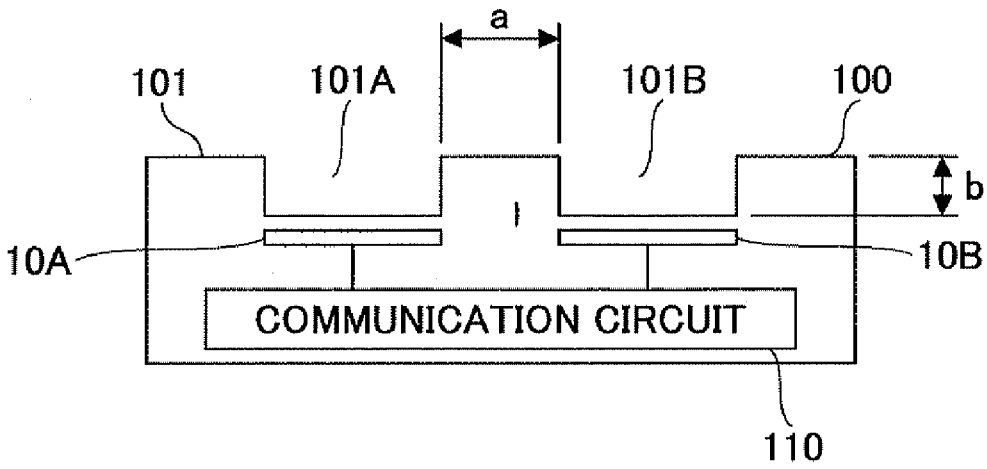
FIG. 3B is an A-A cross section of the communication device shown in FIG. 3A.
Figure 3C:
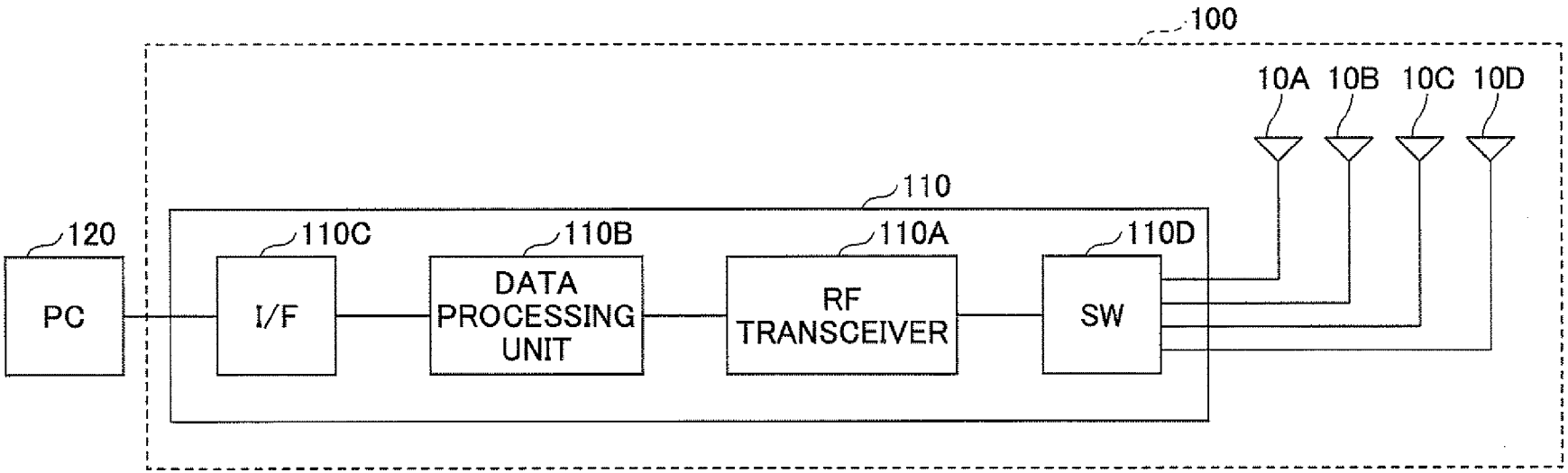
FIG. 3C is a schematic drawing of a block diagram of the communication device according to embodiment 1.

FIG. 3A is a schematic drawing of the communication device according to embodiment 1. FIG. 3B is an A-A cross section of the communication device shown in FIG. 3A. FIG. 3C is schematic drawing of a block diagram of the communication device according to embodiment 1.

As shown in FIG. 3A, the communication device 100 of embodiment 1 includes four antenna apparatuses 10A, 10B, 10C and 10D, and a container 101. These four antenna apparatuses 10A-10D are an example of the antenna apparatus 10 described above and shown in FIGS. 1 and 2. The container 101 has four recessed portions 101A, 101B, 101C and 101D arranged in a matrix.

The antenna apparatuses 10A, 10B, 10C and 10D are disposed inside of the container 101 and located in the back side of the bottom surfaces of the recessed portions 101A-101D respectively.

As shown in FIG. 3B, i.e. in the A-A sectional view of FIG. 3A, the antenna apparatuses 10A, 10B, and a communication circuit 110 are disposed inside of the container 101 of the communication device 100. Although only the antenna apparatuses 10A and 10B are shown in FIG. 3B, the antenna apparatuses 10C and 10D are also disposed inside of the container 101 in the same manner as the antenna apparatuses 10A and 10B.

As to dimensions of the recessed portions 101A and 101B, for example, the distance "a" between the recessed portions 101A and 101B is a few centimeters, the depth "b" is a few centimeters, and the length of each side of square opening is, for example, ten centimeters. These dimensions are the same as those of the recessed portions 101C and 101D.

Herein, the communication device 100 is connected to a PC (Personal Computer) 120 that is shown as a host apparatus.

As shown in FIG. 3C, the communication circuit 110 includes an RF transceiver 110A connected to the antenna apparatuses 10A-10D, a data processing unit 110B, an interface circuit (I/F) 110C, and a switch 110D.

The RF transceiver 110A superimposes transmitting data that is input from the data processing unit 110B onto an RF signal (carrier wave), modulates the superimposed data, and then outputs the modulated data. On the other hand, the RF transceiver 110A demodulates the data received via the antenna apparatuses 10A-10D, removes the RF signal, and then outputs the data to the data processing unit 110B.

The data processing unit 110B converts analog transmitting data into digital data, and converts digital received data into analog data.

The interface circuit 110C data communicates with the PC 120.

The switch 110D connects any of the antenna apparatuses 10A-10D and the RF transceiver 110A.

The types of data communicated via the antenna apparatuses 10A-10D are defined differently, i.e. for example, graphics data for the antenna apparatus 10A, music data for the antenna apparatus 10B, document data for the antenna apparatus 10C, and other data for the antenna apparatus 10D.

If a terminal device that includes an antenna apparatus such as the antenna apparatus 10 is proximate to any of the recessed portions 101A-101D, the switch 110D connects any of the antenna apparatuses 10A-10D proximate to the terminal device and RF transceiver 110A.

For example, if a terminal device is proximate to the recessed portion 101A, the switch 110D connects the antenna apparatus 10A and the RF transceiver 110A. Graphics data stored in the terminal device can then be transmitted to the RF transceiver 110A via the antenna apparatus 10A, and then transferred to the PC 120 via the data processing unit 100B and the interface circuit 110C. The data transmitted from the terminal device is reproduced in the PC 120.

The same process is executed if the antenna apparatus 10B, 10C, or 10D receives the music data, the document data, or the other data respectively. The music, document, or the other data transmitted from the terminal device are reproduced in the PC 120.

If a terminal device that includes an antenna apparatus such as the antenna apparatus 10 is proximate to any of the recessed portions 101A-101D, large volume UWB data communication between the terminal device and the communication device 100 becomes available. For example, large volume data such as graphics data or music data etc. is transmitted quickly between the terminal device and the PC 120.

The proximate communication as described above is available in a condition where the distance between the terminal device and any of the antenna apparatuses 10A-10D is, for example, less than a few centimeters, or the terminal device is attached to the bottom surface of any of the recessed portions 101A-101D. Thus, it is possible to protect data confidentiality between the terminal device and the communication device 100.

As described above, according to embodiment 1, the communication device 100 that can provide wide communication band, high data confidentiality, and easy proximate communication is provided.

Herein, for example, the terminal device may be any of a cellular phone handset, a digital camera, a video camera, or a music player etc.

Moreover, a server may be connected to the communication device 100 instead of the PC 120.

As to the proximate communication as described above, the data communication becomes easy, because it is not necessary to connect the terminal device to the communication device 100. It is possible to reproduce the data transmitted from the terminal device, in the PC 120, merely by approximating the terminal device to the recessed portions 101A-101D.

Although, as described above, the communication device 100 has the recessed portions 101A-101D, the communication device may include convex portions instead of the recessed portions 101A-101D.

Further, the dimensions of the recessed portion are not limited to the dimensions as described above. The dimensions may be varied in order to, for example, fit the dimensions of the terminal device or the container 101.

Furthermore, the number of the recessed portions is not limited to four. The communication device may include any number of recessed portions.

Although, as described above, the communication device 100 includes the RF transceiver 110A and the switch 110D, the circuit configuration of the communication device 100 is not limited thereto. The communication device 100 may include four RF transceivers 100A that are connected to each of the antenna apparatuses 10A-10D, and the switch 100D disposed between the four RF transceivers and the interface circuit 110C.

Embodiment 2

Figure 4:
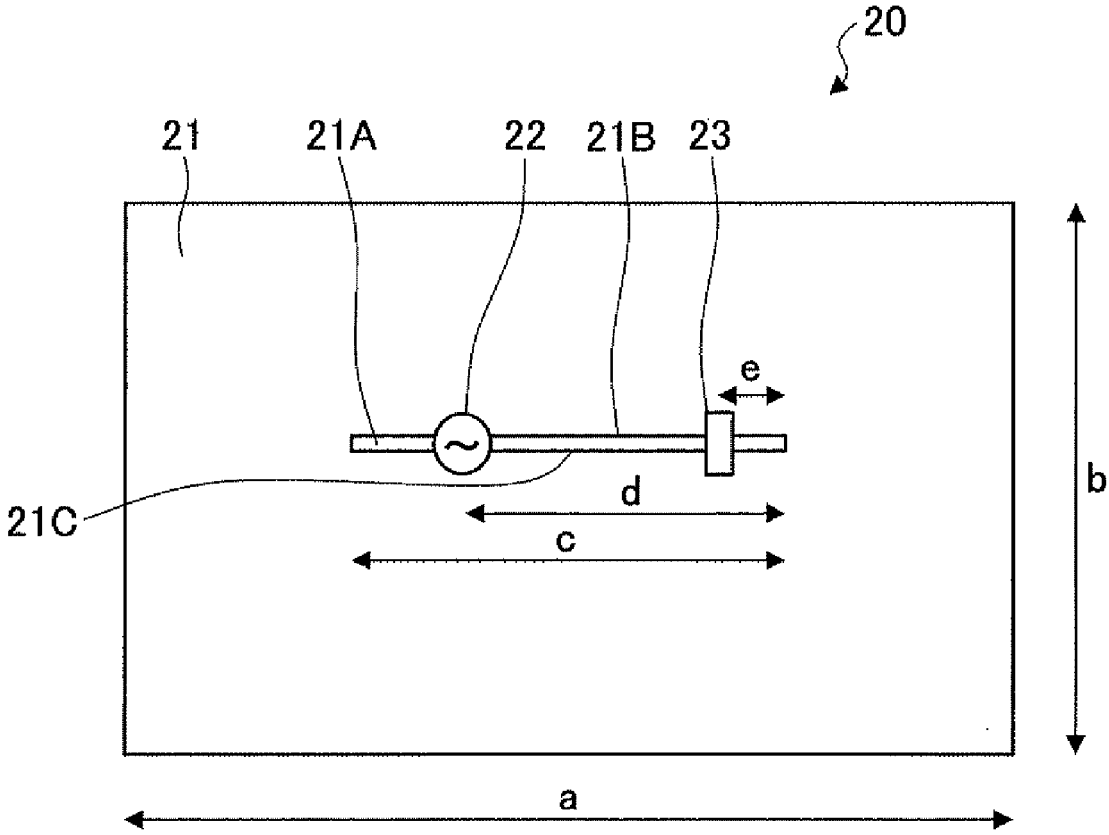
FIG. 4 is a schematic drawing of an antenna apparatus included in a communication device according to embodiment 2.

FIG. 4 is a schematic drawing of a circuit diagram of an antenna apparatus included in a communication device according to embodiment 2.

An antenna apparatus 20 of embodiment 2 includes a ground plane 21, a feeding portion 22 connected to a slot portion 21A of the ground plane 21, and a resistor 23 connected to the slot portion 21A.

The illustrated ground plane 21 is an element that has a substantially rectangular shape in planar view, and is grounded. The ground plane 21 is a metallic film, for example, made of copper, for example. The ground plane 21 has the slot portion 21A that is formed longitudinally and substantially in the center in planar view. The slot portion 21A is cutout through the ground plane 21.

The feeding portion 22 is a terminal via which electrical power is fed to the antenna apparatus 20 from an external power supply. According to embodiment 2, the feeding portion 22 is connected to the ground plane 21 over the slot 21A in a manner that a cable core of a coaxial cable is connected to the one side 21B of the slot 21 and a shielded line of the coaxial cable is connected to the other side 21C. A high-frequency voltage, for example at around 3 GHz to 5 GHz, is applied to the feeding portion 22 via the coaxial cable.

The resistor 23 is connected to the ground plane 21 over the slot portion 21A in a manner that one end of the resistor 23 is connected to the side 21B of the slot portion 21A and the other end of the resistor 23 is connected to the other side 21C of the slot portion 21A. Thus the resistor 23 is disposed over the slot while the ends of the resistor 23 are connected to the ground plane 21. The resistance of the resistor 23 is set to, for example, 51Ω.

The resistance of the resistor 23 is not limited to 51Ω. The resistance can be varied as long as impedance matching between the feeding portion 22 and the resistor 23 is obtained.

The antenna apparatus of embodiment 2 includes the resistor 23. The antenna apparatus provides an ultra-wide frequency band when a high-frequency voltage is fed to the ground plane 21 via the feeding portion 22. In addition, the as-shown antenna apparatus 20 does not cause resonance, because the as-shown antenna apparatus of embodiment 2 does not include inductance (L) or capacitance (C).

Figure 5:
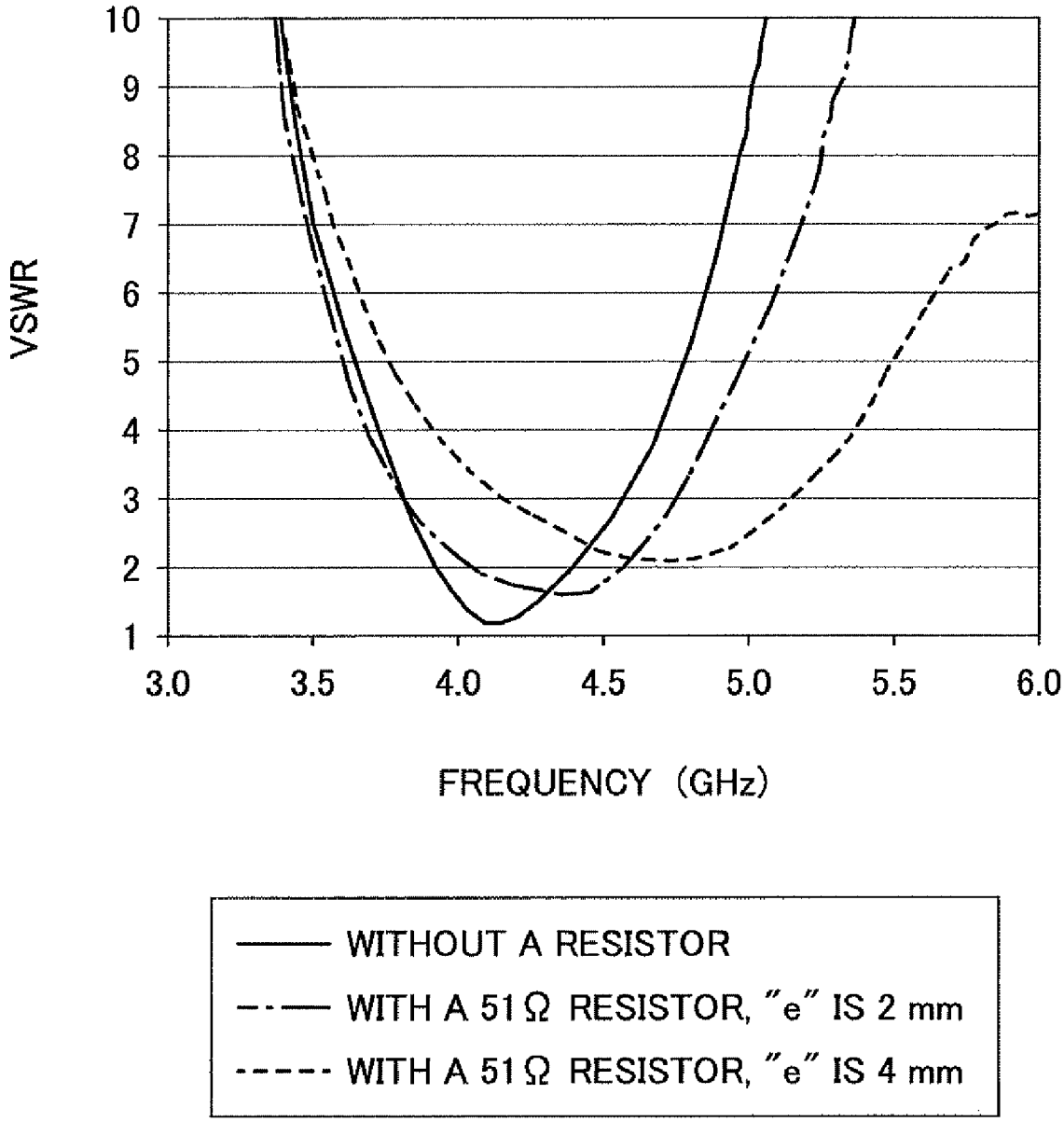
FIG. 5 is a graph showing VSWR characteristics of an antenna apparatus included in a communication device according to embodiment 2.

FIG. 5 is a graph showing VSWR characteristics of an antenna apparatus included in a communication device according to embodiment 2. The VSWR characteristics shown in FIG. 5 are obtained in the condition where the length of a longitudinal side of the ground plane 21 "a" is 39 mm, the width of the ground plane 21 "b" is 29 mm, the length of the slot portion 21A "c" is 24 mm, the length from the right side end of the slot portion 21A to the feeding portion 22 "d" is 21.1 mm, and the length from the right side end of the slot portion 21A to the resistor 23 "e" is varied.

The VSWR characteristic represented in dashed line shown in FIG. 5 is obtained in the condition where the length "e" is 4 mm and the resistance of the resistor 23 is 51Ω. As to the other characteristics, the alternating long and short dash line characteristic is obtained in the condition where the length "e" is 2 mm and the resistance of the resistor 23 is 51Ω, and the solid line characteristic is obtained in the condition where the length "e" is 4 mm and the resistance of the resistor 23 is 0Ω (i.e. without a resistor).

In the condition where "e" is 4 mm, shown in the dashed line, the antenna apparatus 20 provides a frequency band, with VSWR less than 4.0, ranged from 3.92 GHz to 5.36 GHz, i.e. the band width is 1.44 GHz.

Further, in the condition where "e" is 2 mm, shown in the alternating long and short dash line, the antenna apparatus provide the frequency band, with VSWR less than 4.0, ranged from 3.69 GHz to 4.87 GHz, i.e. the band width is 1.18 GHz.

In contrast, in the condition where "e" is 4 mm and the resistance is 0Ω, shown in the solid line, the antenna apparatus provides the frequency band, with VSWR less than 4.0, ranged from 3.73 GHz to 4.69 GHz, i.e. the band width is 0.96 GHz.

As will be appreciated from the above, the antenna apparatus 20 of embodiment 2 provides an ultra wide frequency band that is suitable for UWB communication, and the band width is 15 times wider than that of the antenna apparatus (4 mm, 0Ω).

According to embodiment 2 of the present invention, it is possible to provide the antenna apparatus that has the frequency band suitable for UWB communication by connecting a resistor over a slot that is formed in the ground plane.

Since the electrical power is consumed at the resistor 23, the antenna apparatus of embodiment 2 is suitable for low electrical power communication use. And the communication distance may be set to be less than a few centimeters. This communication distance makes it possible to not be influenced by a disturbance.

Further, since the slot portion 21A provides directional characteristics, it is possible to improve data confidentiality between other communication devices and a communication device that includes the antenna apparatus 20 by optimizing the geometries and dimensions of the slot portion 21A.

Further, since the antenna apparatus of embodiment 2 include the resistor, the antenna apparatus of embodiment 2 can provide wide band communication. In addition, the as-shown antenna apparatus of embodiment 2 does not cause resonance, because the as-shown antenna apparatus does not include inductance (L) or capacitance (C).

As will be appreciated from the above, according to embodiment 2, a traveling-wave-type antenna apparatus that is suitable for low electrical power communication, high data confidentiality, and wide band communication is provided merely by connecting the resistor 23 to the ground plane 21 over the slot portion 21A.

As shown in the VSWR characteristics, since the antenna apparatus has a wide band, large volume UWB data communication becomes available.

It is noted that the geometries and dimensions of the slot portion 21A may be varied in order to optimize the desired characteristics of the antenna apparatus 20.

Figure 6A:
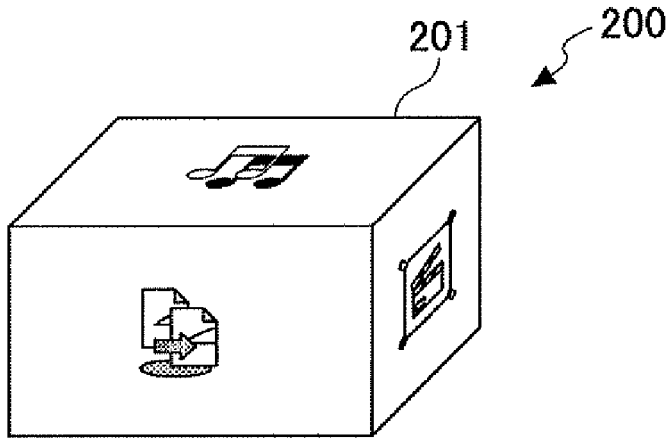
FIG. 6A is a schematic drawing of a terminal device according to embodiment 2.
Figure 6B:
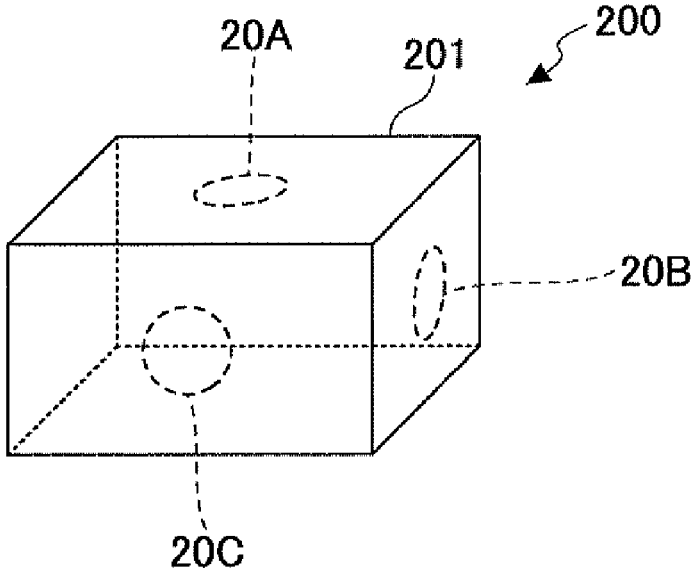
FIG. 6B is a perspective schematic drawing of an inner side of the terminal device.
Figure 6C:
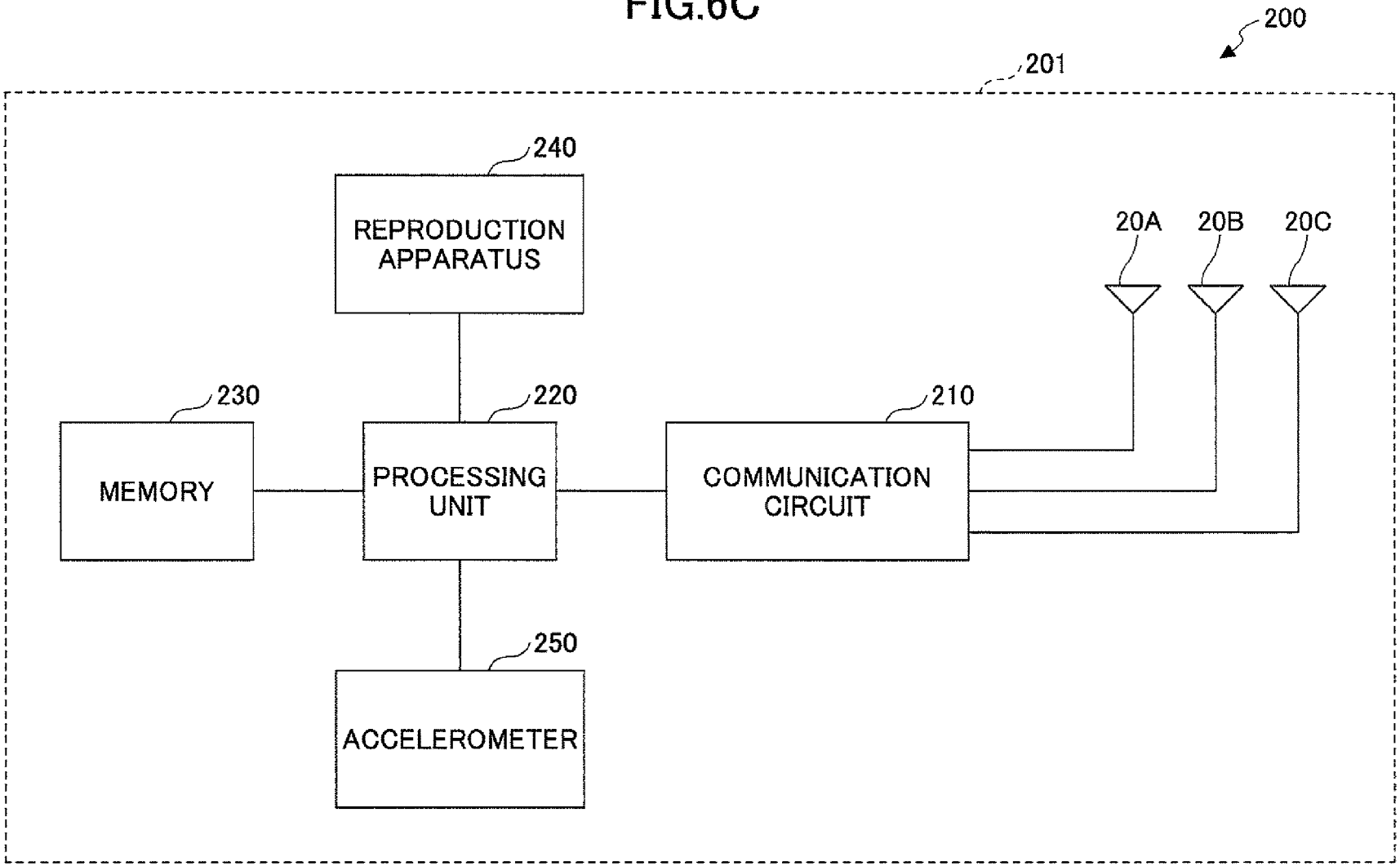
FIG. 6C is a schematic drawing of a block diagram of the terminal device.

FIG. 6A is a schematic drawing of a terminal device according to embodiment 2. FIG. 6B is a perspective schematic drawing of an inner side of the terminal device. FIG. 6C is a schematic drawing of a circuit diagram of the terminal device. The terminal device of embodiment 2 is one of the embodiments of a communication device of the present invention.

As shown in FIG. 6A, a terminal device 200 has a substantially rectangular box-shaped container 201, and includes several of the antenna apparatuses 20 in the container 201.

The container 201 of the terminal device 200 has a music mark, a graphics mark, and a document mark on three surfaces thereof, respectively.

As shown in FIG. 6B, the terminal device 200 includes antenna apparatuses 20A, 20B, and 20C disposed respectively on the insides of the three surfaces of the container 201. Each of the antenna apparatuses 20A-20C is an example of the antenna apparatus 20 shown in FIG. 4.

As shown in FIG. 6C, the antenna apparatuses 20A-20C are connected to a communication circuit 210.

The terminal device 200 includes a processing unit 220, a memory 230, a reproduction apparatus 240, and an accelerometer 250 in the container 201, in addition to the communication circuit 210.

As is further shown in FIG. 6C, the communication circuit 210, the memory 230, the reproduction apparatus 240, and the accelerometer 250 are connected to the processing unit 220. The antenna apparatuses 20A-20C are connected to the communication circuit 210.

The processing unit 220 executes the program that realizes the functions of the terminal device 200. The memory 230 stores the program executed by the processing unit 220. The reproduction apparatus 240 includes a monitor and a speaker.

The processing unit 220 reproduces music data, graphics data, and document data stored in the memory 230, by executing the program stored in the memory 230. Further, the processing unit 220 transfers the data stored in the memory 230 to the communication circuit 210 in order to transmit the data to other communication devices via the antenna apparatus 20A-20D.

The terminal device 200 of embodiment 2 communicates with the communication device 100 of embodiment 1. For example, if the surface with the music mark of the terminal device 200 is proximate to the recessed portion 101B of the communication device 100, the accelerometer 250 detects that the direction in which the surface with music mark is directed toward is downward. The processing unit 220 then transfers the music data stored in the memory 230 to the communication circuit 210, and the antenna apparatus 20A transmits the music data to the communication device 100.

Thus, the PC 120 reproduces the music data received from the terminal device 200.

Similarly, if the surface with the graphics mark of the terminal device 200 is proximate to the recessed portion 101A of the communication device 100, the accelerometer 250 detects that the direction in which the surface with graphics mark is directed downwardly. The processing unit 220 then transfers the graphics data stored in the memory 230 to the communication circuit 210, and the antenna apparatus 20B transmits the graphics data to the communication device 100.

Thus, the PC 120 reproduces the graphics data received from the terminal device 200.

Further, if the surface with the document mark of the terminal device 200 is proximate to the recessed portion 101C of the communication device 100, the accelerometer 250 detects that the direction in which the surface with document mark is directed toward downward. The processing unit 220 then transfers the document data stored in the memory 230 to the communication circuit 210, and the antenna apparatus 20C transmits the document data to the communication device 100.

Thus, the PC 120 reproduces the document data received from the terminal device 200.

As will be appreciated from the above, according to embodiment 2, large volume UWB data communication via the terminal device 200 becomes available.

According to the proximate communication described above, it is not necessary to connect the terminal device 200 to the communication device 100 via a connector or the like. The proximate communication therebetween becomes available merely by approximating the terminal device 200 to the recessed portions 101A-101D of the communication device 100. As a result, the data communication becomes easier. It is possible to transmit music data, graphics data or the like stored in the memory 230 to the communication device 100, by approximating the terminal device 200 to the recessed portions of the communication device 100. Then, the received data is reproduced by the PC 120.

The proximate communication as described above is available in a condition where the distance between the antenna apparatus of the terminal device 200 and the antenna apparatus of the communication device 100 is less than a few centimeters, or the terminal device 200 is attached to the bottom surface of any of the recessed portions 101A-101D of the communication device 100. Thus, it is possible to protect data confidentiality between the terminal device 200 and the communication device 100.

The embodiment described with respect to FIGS. 6A and 6B shows a rectangular box shaped container having six surfaces and antenna apparatuses on the insides of three of the surfaces. The container may have any shape and any number of antenna apparatuses. For example, the rectangular shaped container may have one antenna apparatus disposed on one of its six surfaces. Alternatively, the container may have a cylindrical shape and antenna apparatuses disposed on insides of its two end surfaces. Still further, the container may be cone shaped and have one antenna disposed on the inside of its base surface.

As will be appreciated from the above, according to embodiment 2, a terminal device 200 that can provide wide communication band, high data confidentiality, and easy proximate communication is provided.

Herein, for example, the terminal device 200 may be any of a cellar phone, a digital camera, a video camera, or a music player etc.

Although, as described above, the terminal device 200 has the function to reproduce music data, graphics data, and document data, the terminal device 200 need not necessarily have all such functions.

Although, as described above, the terminal device 200 transmits data to the communication device 100, the terminal device 200 may receive data from the communication device 100, and may reproduce the received data.

Although, as described above, the terminal device includes the antenna apparatus 20, the terminal device 200 may include the antenna apparatus 10.

Embodiment 3

Figure 7:
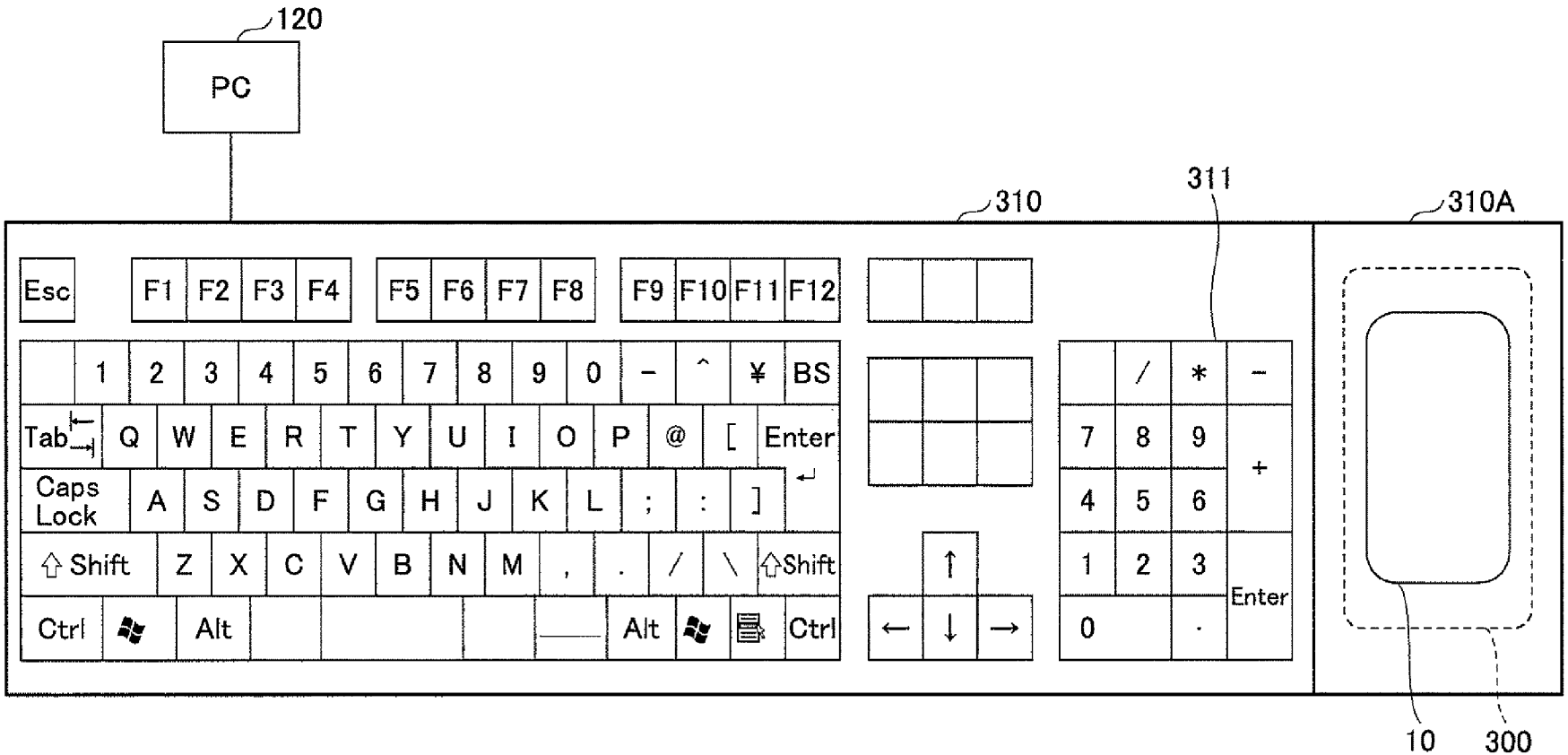
FIG. 7 is a schematic drawing of a communication device of embodiment 3.

FIG. 7 is a schematic drawing of a communication device of embodiment 3. Embodiment 3 is a modified embodiment of embodiment 1, thus the same symbols are used for the same elements, and the explanation thereof is omitted.

A communication device 300 of embodiment 3 is included in a keyboard 310 of the PC 120. As shown in FIG. 7, the keyboard 310 has an extended body portion 310A next to one or more keys 311. The communication device 300 is included in the extended body portion 310A. The antenna apparatus 10 is disposed in the top surface of the extended body portion 310A.

A large volume UWB data communication becomes available if the terminal device 200 is proximate to the antenna apparatus 10 disposed in the top surface of the extended body portion 310A.

Accordingly, it becomes possible to communicate between the communication device 300 of embodiment 3 and the terminal device 200 of embodiment 2.

According to the proximate communication described above, it is not necessary to connect the terminal device 200 to the communication device 300 via a connector or the like. The proximate communication therebetween becomes available merely by approximating the terminal device 200 to the extended body portion 310A of the communication device 300. As a result, the data communication becomes easier. It is possible to transmit music data, graphics data or the like stored in the memory 230 to the communication device 300, by approximating the terminal device 200 to the extended body portion 310A of the communication device 300.

As will be appreciated from the above, according to embodiment 3, a communication device 300 and a system including the same that can provide wide communication band, high data confidentiality, and easy proximate communication is provided.

Embodiment 4

Figure 8A:
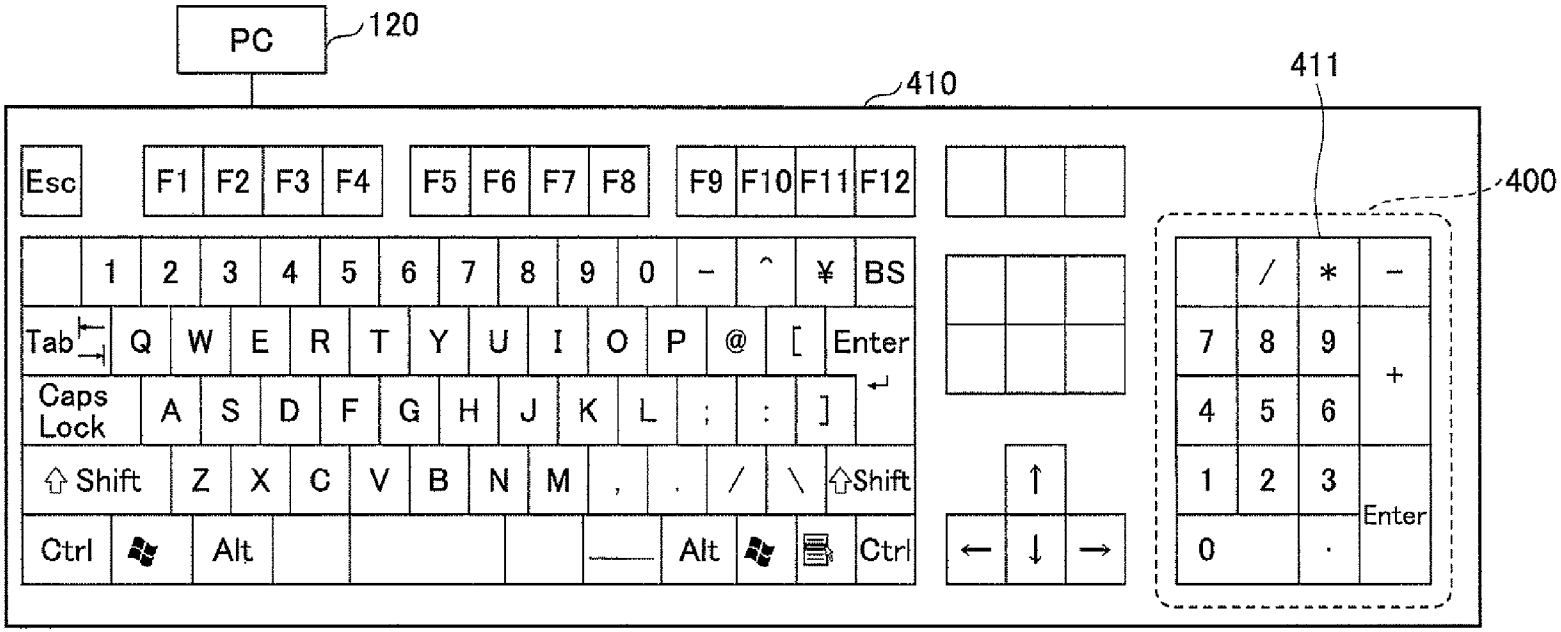
FIG. 8A is a schematic drawing of a communication device of embodiment 4 in plan view.
Figure 8B:
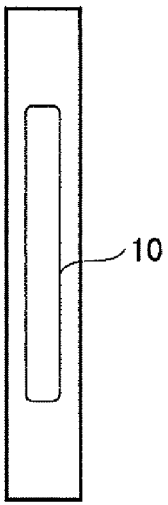
FIG. 8B is a schematic drawing of a communication device of embodiment 4 in side view.

FIG. 8A is a schematic drawing of a communication device of embodiment 4 in plan view. FIG. 8B is a schematic drawing of a communication device of embodiment 4 in side view. Embodiment 4 is a modified embodiment of embodiment 3, thus the same symbols are used for the same elements, and the explanation thereof is omitted.

As shown in FIG. 8A, a communication device 400 is included in a body of a keyboard 410, and disposed under one or more keys 411.

The antenna apparatus 10 of the communication device 400 is disposed in the side surface of the body of the keyboard 410.

A large volume UWB data communication becomes available if the terminal device 200 is proximate to the antenna apparatus 10 disposed in the side surface of the keyboard 410.

Accordingly, it becomes possible to communicate between the communication device 400 of embodiment 4 and the terminal device 200 of embodiment 2.

The proximate communication as described above is available in a condition where the distance between the antenna apparatus of the terminal device 200 and the antenna device of the communication device 400 is less than a few centimeters, or the terminal device 200 is attached to the side surface of keyboard 410 of the communication device 400. Thus, it is possible to protect data confidentiality between the terminal device 200 and the communication device 400.

As described above, according to embodiment 4, a communication device 400 and a system including the same that can provide wide communication band, high data confidentiality, and easy proximate communication is provided.

Embodiment 5

Figure 9:
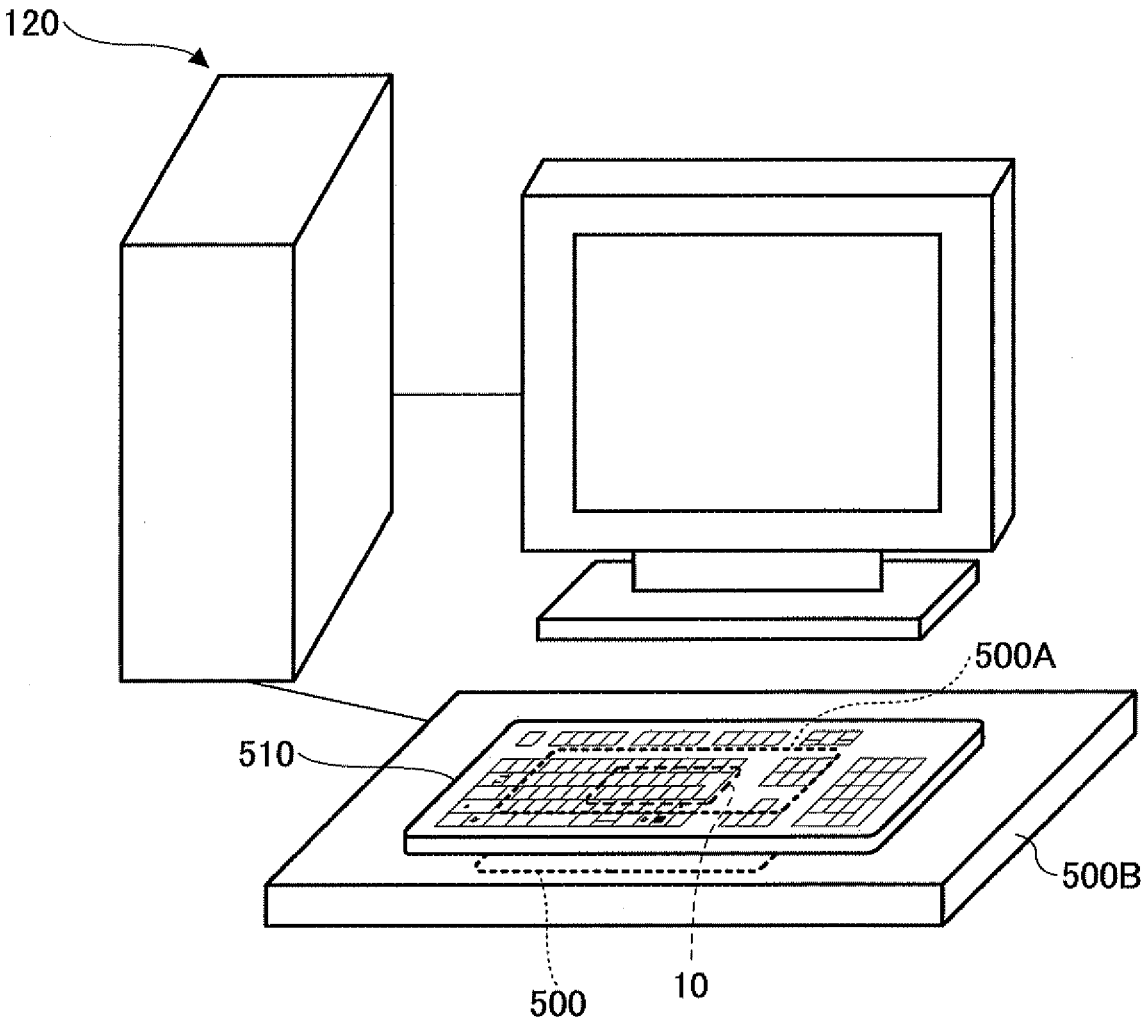
FIG. 9 is a schematic drawing of a communication device of embodiment 5.

FIG. 9 is a schematic drawing of a communication device of embodiment 5. Embodiment 5 is a modified embodiment of embodiments 3 and 4, thus the same symbols are used for the same elements, and the explanation thereof is omitted.

A communication device 500A is included in the body of the keyboard 510, and has an antenna apparatus 10 disposed at a bottom side of the body of the keyboard 510.

The PC 120 is connected to a communication device 500B. The communication device 500B has a thin board type body that can mount the keyboard 510 thereon, and has an antenna apparatus 10 disposed to the top side of the body. The communication devices 500A and 500B communicate with each other. Thus, if the keyboard 510 is mounted on the communication device 500B, the antenna apparatuses 10 of the communication devices 500A and 500B are proximate to each other. Thus data communication becomes available therebetween.

The communication device 500A transmits the data input through the keyboard 510 to the communication device 500B. Thus, the proximate communication makes it possible to operate the PC 120 through the keyboard 510 that is not physically connected thereto.

A large volume proximate data communication becomes available between the systems that include the communication devices 500A and 500B respectively.

The proximate communication as described above is available in a condition where the distance between the antenna apparatus of the communication devices 500A and 500B is less than a few centimeters, or the communication device 500A is attached to the communication devices 500B. Thus, it is possible to protect data confidentiality between the communication devices 500A and 500B.

As will be appreciated from the above, according to embodiment 5, the communication devices 500A and 500B and a system including the same that provide wide communication band, high data confidentiality, and easy proximate communication are provided.

Herein, the communication devices 500A and 500B may have specific ID information, and an ability to communicate with each other when the specific ID match each other.

In this case, it is possible to operate the PC 120 merely through the communication device 500A that has the specific ID matched with that of the communication device 500B. Thus the security level of the system is improved.

Further, the present invention is not limited to these embodiments, but variations and modifications may be made without departing from the scope of the present invention.

The present application is based on Japanese Priority Application No. 2008-217587 filed on Aug. 27, 2008 with the Japanese Patent Office, the entire contents of which are hereby incorporated by reference.

What is claimed is:

1. A communication device comprising:

an antenna apparatus including a plurality of antenna parts, each of the plurality of antenna parts including a looped antenna element, a feeding portion coupled to the looped antenna element and configured to feed power to the looped antenna element, and a resistor disposed at a midpoint of a loop formed by the looped antenna element; and a communication circuit configured to process data transmitted and received via the antenna apparatus, wherein the antenna apparatus includes no inductance or no capacitance, and wherein the communication circuit includes a switch coupled to the plurality of antenna parts, and a transceiver configured to superimpose transmitting data onto a carrier wave and perform a modulation to output modulated data to the switch, and to demodulate received data received via the switch and remove the carrier wave.

2. The communication device as claimed in claim 1, wherein a length of the looped antenna element including the resistor in the antenna part is approximately equal to a single-wavelength of a communication frequency at which the communication device operates.

3. The communication device as claimed in claim 1, wherein the communication circuit further includes a data processing unit configured to perform a digital-to-analog conversion in order to output the transmitting data to the transceiver, and to perform an analog-to-digital conversion on the received data received from the transceiver.

4. The communication device as claimed in claim 3, wherein the communication circuit further includes a processing unit configured to reproduce the received data subjected to the analog-to-digital conversion.

5. The communication device as claimed in claim 4, wherein the plurality of antenna parts include a first antenna part to transmit and receive graphics data, a second antenna part to transmit and receive music data, a third antenna part to transmit and receive document data, and a fourth antenna part to transmit and receive data other than the graphics, music and document data.

6. The communication device as claimed in claim 1, wherein the plurality of antenna parts are arranged in a planar pattern, and a loop formed by one antenna element is adjacent side by side to at least another loop formed by another antenna element on a single plane.

7. An antenna device comprising:

a plurality of antenna parts arranged in a planar pattern, each of the antenna parts including an antenna element;

a resistor disposed at a midpoint of a loop formed by the antenna element; and a feeding portion coupled to the antenna element and configured to feed power to the antenna element wherein a loop formed by one antenna element is adjacent side by side to at least another loop formed by another antenna element on a single plane.

8. The antenna device as claimed in claim 7, wherein a length of the looped antenna element including the resistor in one antenna part is approximately equal to a single-wavelength of a communication frequency at which a communication is made via the one antenna part.

9. A communication device comprising:

an antenna apparatus including a plurality of antenna parts, each of the plurality of antenna parts including a looped antenna element, a feeding portion coupled to the looped antenna element and configured to feed power to the looped antenna element, and a resistor disposed at a midpoint of a loop formed by the looped antenna element; and a communication circuit configured to process data transmitted and received via the antenna apparatus, wherein the communication circuit includes a switch coupled to the plurality of antenna parts, and a transceiver configured to superimpose transmitting data onto a carrier wave and perform a modulation to output modulated data to the switch, and to demodulate received data received via the switch and remove the carrier wave.

10. The communication device as claimed in claim 9, wherein the communication circuit further includes a data processing unit configured to perform a digital-to-analog conversion in order to output the transmitting data to the transceiver, and to perform an analog-to-digital conversion on the received data received from the transceiver.

11. The communication device as claimed in claim 10, wherein the communication circuit further includes a processing unit configured to reproduce the received data subjected to the analog-to-digital conversion.

12. The communication device as claimed in claim 11, wherein the plurality of antenna parts include a first antenna part to transmit and receive graphics data a second antenna part to transmit and receive music data, a third antenna part to transmit and receive document data, and a fourth antenna part to transmit and receive data other than the graphics, music and document data.

13. The communication device as claimed in claim 9, wherein the plurality of antenna parts are arranged in a planar pattern, and a loop formed by one antenna element is adjacent side by side to at least another loop formed by another antenna element on a single plane.

* * * * *